United States Patent [19]

Gründler et al.

[11] 4,373,557

[45] Feb. 15, 1983

[54] APPARATUS FOR PICKING THE SHUTTLES OF A LOOM

[75] Inventors: Robert Gründler, Arbon; Josef Fuchs, Steinach, both of Switzerland; Herbert Jenni, Götzis, Austria

[73] Assignee: Aktiengesellschaft Adolph Saurer, Arbon, Switzerland

[21] Appl. No.: 250,941

[22] Filed: Apr. 6, 1981

[30] Foreign Application Priority Data

Apr. 24, 1980 [CH] Switzerland ..... 3176/80

[51] Int. Cl.[3] ..... D03D 42/24

[52] U.S. Cl. ..... 139/142; 139/186

[58] Field of Search ..... 139/18, 142, 186, 443

[56] References Cited

U.S. PATENT DOCUMENTS 2,237,760 3/1941 Goldman et al. ..... 139/18
3,140,633 7/1964 Vincent ..... 139/443
3,587,667 6/1971 Porter ..... 139/142
3,889,722 6/1975 Porter ..... 139/142

*Primary Examiner*—Henry Jaudon
*Attorney, Agent, or Firm*—Werner W. Kleeman

[57] ABSTRACT

An apparatus for picking or firing a projectile-like shuttle contains a pair of rolls revolving at a relatively high rotational speed. The rolls of the roll pair can be simultaneously brought into contact with a related shuttle in order to accelerate the same by frictional forces. To that end the rolls are each arranged upon a pivotal arm and operatively connected with a control arrangement. The rolls possess a predetermined elasticity such that their radial springiness or resilient yielding action at least approximately linearly increases as a function of the increasing radial contact pressure upon bringing the rolls into contact with the shuttles. These measures ensure for a practically wear-free, absolutely precise and controllable mode of operation of the apparatus.

6 Claims, 5 Drawing Figures

APPARATUS FOR PICKING THE SHUTTLES OF A LOOM

BACKGROUND OF THE INVENTION

The present invention relates to a new and improved construction of an apparatus for picking or firing shuttles, especially projectile-like shuttles of a loom.

Generally speaking, the apparatus of the present development is of the type comprising at least one pair of driven rolls which can be brought into contact with opposite sides of the shuttles which are to be inserted into the weaving shed. The rolls of the pair of rolls each are rotatably mounted at a spring-loaded pivotal lever which can be pivoted about a stationary axis or shaft.

Equipment of this type has already been disclosed to the art in Swiss Pat. No. 536,889 and Swiss Pat. No. 558,437 of the same assignee as the instant application. There are provided a plurality of driven pairs of rolls arranged in succession in the shuttle picking or firing direction. At least part of the pairs of rolls simultaneously serve to brake the shuttles and they can be alternatively brought out of an ineffectual position into an effectual operative association or connection with the related shuttle.

This prior art equipment has not however been found to be suitable in practice since already after 200,000 to 400,000 load changes it becomes unusable. The reason for this is that there prevails an impermissibly high relative movement between the circumference of the rolls and the shuttles, so that owing to rapid wear at the projectile-like shuttles and the picking rolls the picking or the firing of the shuttles can no longer be controlled. A further notable disadvantage is that by virtue of the differential movements during shuttle firing or picking by a number of rolls, the wear becomes appreciably greater. This drawback is hardly enhanced by using a more improved construction wherein there is provided at the last pair of rolls a slipping clutch between the rolls and the drive.

It has also been contended in the publication "Melliand Textilberichte" 5/1968, page 535, that the technique of accelerating a thread-carrying projectile by means of rolls would never find significance in the loom or weaving technology.

SUMMARY OF THE INVENTION

Therefore, with the foregoing in mind it is a primary object of the present invention to provide a new and improved construction of apparatus for picking the shuttles of a loom which is not associated with the afore-mentioned drawbacks and limitations of the prior art constructions.

Another and more specific object of the invention aims at providing, contrary to the assertions of those skilled in the art, an apparatus of the previously-mentioned type which enables picking the shuttles of a loom with shuttle picking or firing rolls while ensuring for as low as possible wear during the operation of the picking apparatus and wherein additionally this wear can be quite effectively controlled.

A further significant object of the present invention aims at appreciably reducing the constructional expenditure in a picking apparatus for shuttles of a loom by using appreciably fewer parts and also significantly reducing the development of noise in relation to state-of-the-art apparatuses.

Still a further significant object of the present invention is directed to an improved construction of apparatus for picking the shuttles of a loom, which apparatus is relatively simple in construction and design, economical to manufacture, extremely reliable in operation, not readily subject to breakdown or malfunction, and requires a minimum of maintenance and servicing.

In order to implement these and still further objects of the invention, which will become more readily apparent as the description proceeds, the shuttle picking apparatus of the present development is manifested by the features that the free ends of both pivotal levers which extend essentially parallel to the shuttle trajectory and exposed to the action of pressure or compression springs, are operatively connected or associated with an adjustment or setting element of a device for the simultaneous application or contacting of both of the rolls with the shuttles. The rolls possess a radial resilient-yielding action or springiness which increases at least approximately linearly as a function of the increasing radial contact pressure during application or contacting of the picking rolls at the shuttles.

According to one manifestation of the invention, the adjustment element is advantageously designed such that it comprises a revolving control cam.

A further advantageous construction resides in the adjustment element generating a contact or pressing force of the rolls at the shuttles which at most amounts to about 150 N.

Furthermore, it is advantageous if the Shore-hardness of the rolls at least approximately linearly increases as a measure of their elasticity as a function of the increase in the mass of the employed shuttles. This can be obtained if the rolls comprise a steel outer ring and a steel hub, between which there is arranged a rim formed of a suitable dampening material of predetermined Shore-hardness. It is advantageous if the dampening material of the rolls or rollers possesses a Shore-hardness in a range of about 40° to about 60° Shore.

Due to the arrangement of only a single pair of rolls in conjunction with the adjustment or setting element of the roll contact device, it has been surprisingly found that, contrary to the prevailing opinion that this technique only can be adopted in connection with extremely heavy shuttles, it nonetheless can be beneficially used in conjunction with shuttles having a gram weight range while attaining a shuttle acceleration which is satisfactory in all respects.

In order to obtain a precise positioning of the projectile-like shuttles between the rolls, there is arranged a braking or brake stage after the rolls, viewed in the direction of the incoming or arriving shuttles.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
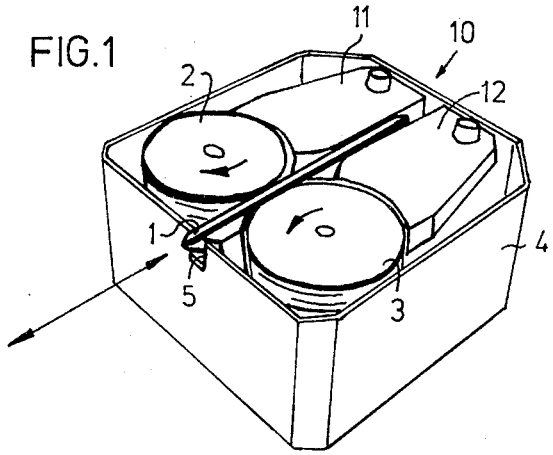
FIG. 1 is a perspective view of an exemplary embodiment of inventive shuttle picking apparatus in conjunction with a braking stage or arrangement.

Describing now the drawings, the exemplary embodiment of apparatus shown in FIG. 1 for the firing or picking of projectile-like shuttles 1, of a not here further shown but conventional loom or weaving machine, will be seen to comprise a braking stage or arrangement 10 which, viewed in the direction of the incoming or arriving shuttles 1, has arranged thereafter a pair of rolls containing the firing or picking rolls 2 and 3. This braking stage or arrangement 10 contains braking jaws 11 and 12 and serves for braking the arriving or incoming shuttles 1 as well as for their precise positioning in relation to the roll pair 2 and 3.

Braking stage 10 can be constructed in the manner disclosed in Austrian Pat. No. 344,621 of the same assignee as this application, so that a detailed discussion thereof is unnecessary, particularly since the construction of the braking arrangement 10 is not important as concerns the principles and concepts of the present invention. In any event, as far as the braking stage 10 is concerned, reference may be had to the disclosure of the afore-mentioned Austrian Pat. No. 344,621 which is incorporated herein in its entirety by reference.

The shuttle picking apparatus shown in FIG. 1 is surrounded by a housing form 4 and has a size or dimension which enables this apparatus to be arranged upon a moveable sley of the loom. As to the pair of rolls each of the rolls or rollers 2 and 3 thereof can be driven so as to revolve at a relatively high rotational speed by any suitable and conventional drive means. Each of the rolls 2 and 3 is mounted such that it can be brought into contact with the shuttles 1 at one side of the shuttle compartment 5.

Figure 2:
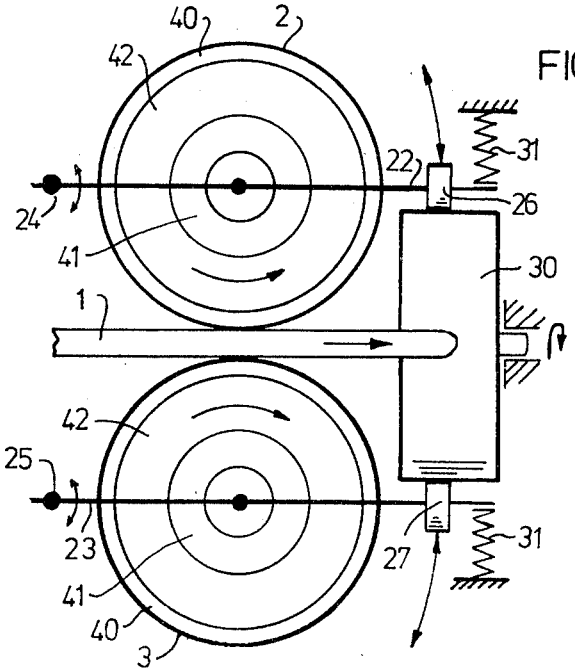
FIG. 2 is a schematic top plan view illustrating the function of the inventive apparatus.

From the illustration of FIG. 2, there will be apparent the function of the shuttle picking apparatus of the present development. It will be seen that each roll 2 and 3 is arranged upon support means, here shown in the form of laterally outwardly rockable, pivot arms 22 and 23, respectively. These pivotable or pivot arms 22 and 23 have their respective pivot points 24 and 25 at the central region thereof and carry at one end thereof a respective control roll or cam follower 26 and 27 which, in this case, is an operative association with a control cam 30 or equivalent structure. Contact of the cam followers 26 and 27 with the control cam 30 can be maintained by the use of any suitable biasing device, such as the illustrated springs 31. At the other not particularly shown end, the pivotal arms 22 and 23 carry the related structure of the afore-mentioned braking arrangement or stage 10.

The thus constructed control arrangement, in synchronism with the cycle of the weft insertion at the loom, initially opens the pair of rolls 2 and 3 in order to allow the arriving shuttle 1 access to the braking stage or arrangement 10. On the other hand, the control arrangement enables placement of the rolls 2 and 3 into contact with the shuttle 1, in order to accelerate such shuttle by virtue of the frictional forces prevailing upon contact of the rotating rolls 2 and 3 with the shuttle 1 to propel the shuttle out of the shuttle picking apparatus and through the weaving shed.

By virtue of the described arrangement, it is therefore possible for both of the rolls 2 and 3 to act exactly simultaneously and with the same pressure at the shuttle 1.

It has been found that the contact force of the rolls 2 and 3 at the shuttle 1, independent of its size and configuration, should not exceed 150 N, in order to render possible the greatest utilization of the energy for the acceleration of the shuttle 1.

Moreover, it has been found that in order to ensure for minimum wear, a constant projectile velocity and suppression of radial vibrations or oscillations, slip and impact effects, an intimate correlation or relationship prevails between the radial contact pressure and the radial resilient-yielding action or springiness of the rolls 1 and 2.

Figure 3:
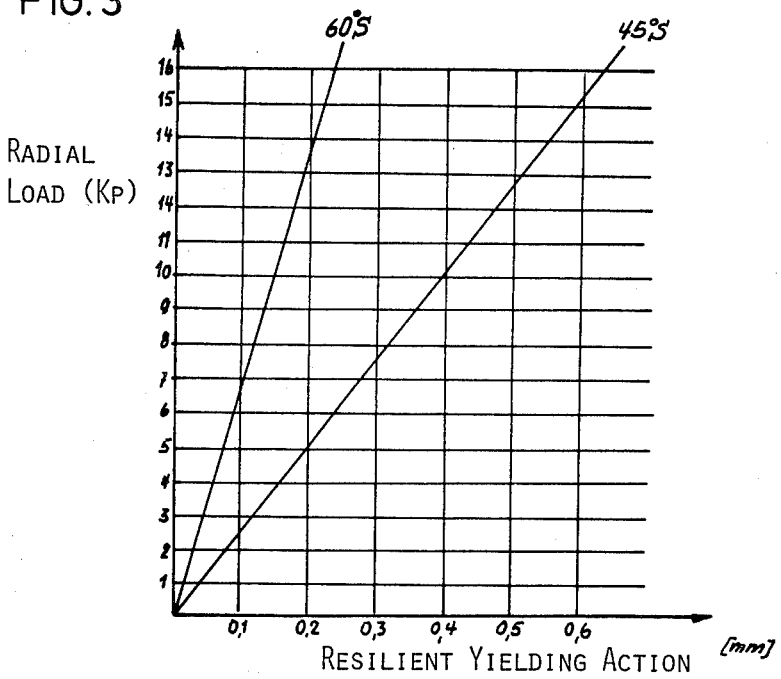
FIG. 3 is a diagram which graphically portrays the radial roll load as a function of its resilient-yielding action or springiness.

This relationship can be best ascertained by referring to FIG. 3, where it will be seen that for a given elasticity of the rolls 2 and 3 the radial resilient-yielding action linearly increases as a function of the increasing radial contact pressure during contact of the rolls 2 and 3 with the shuttle 1.

To obtain this, the rolls 2 and 3 advantageously contain a steel outer ring 40 (FIG. 2) and a steel hub 41 between which there is arranged a rim or annulus 42 formed of a suitable dampening material of predetermined Shore-hardness, such as rubber or plastics material.

Figure 4:
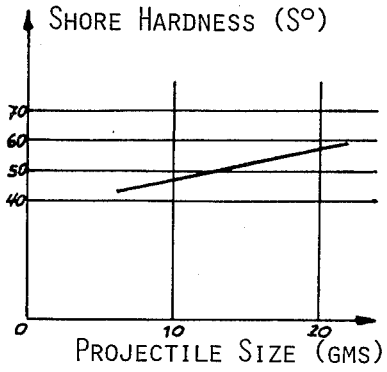
FIG. 4 is a diagram which graphically portrays the Shore-hardness of the rolls as a function of the size or weight of the projectile-like shuttles.

FIG. 4 shows that this Shore-hardness is in a range of about 40° to 60° and independent of the gram weight of the relevant shuttle 1.

Figure 5:
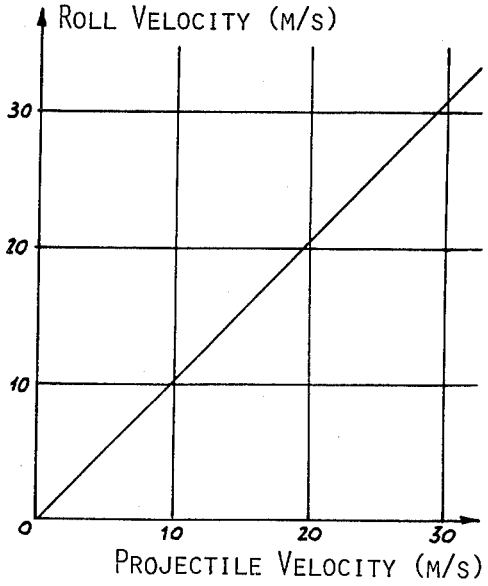
FIG. 5 is a diagram which graphically portrays the roll velocity of the projectile-like shuttles.

Furthermore, it will be seen from FIG. 5 that practically with a ratio of 97/100 the roll velocity can be transmitted to the projectile-like shuttles 1.

This in conjunction with a practically negligible wear of comparable prior art apparatuses of this type results in a shuttle picking apparatus for looms which fulfills all of the previously-mentioned requirements. Of course, there are possible within the teachings and framework of the invention, without departing from the underlying principles and concepts, a spate of modifications. In particular, the control arrangement can encompass further electrial and/or hydraulic and/or pneumatic setting or adjustment elements.

While there are shown and described present preferred embodiments of the invention, it is to be distinctly understood that the invention is not limited thereto, but may be otherwise variously embodied and practiced within the scope of the following claims.

Accordingly, what we claim is:

1. An apparatus for picking shuttles, especially projectile-like shuttles of a loom, comprising:

at least one pair of driven rolls which can be placed into contact with opposite sides of a shuttle to be inserted into a shed along a predetermined trajectory;

a respective spring-loaded pivotal lever at which there is rotatably mounted a related one of the rolls;

said pivotal levers extending essentially parallel to the shuttle trajectory;

each of said pivotal levers being pivotable about a stationary axis and having a free end;

means for simultaneously placing both of the rolls into contact with the shuttle;

said placing means including an adjustment element;

pressure springs acting at said free ends of said pivotal levers for placing the free ends of both pivotal levers into operative association with said adjustment element; and said rolls possessing a radial resilient-yielding action which increases at least approximately lineraly as a function of the increasing radial contact pressure upon placement of the rolls into contact with the shuttle.

2. The apparatus as defined in claim 1, wherein:

the adjustment element comprises a revolving control cam.

3. The apparatus as defined in claim 2, wherein:

the adjustment element generates a contact force of the rolls at the shuttle which does not exceed approximately 150 N.

4. The apparatus as defined in claim 1, wherein:

the adjustment element generates a contact force of the rolls at the shuttle which does not exceed approximately 150 N.

5. The apparatus as defined in claim 1, wherein:

each of the said rolls possesses a steel outer ring and a steel hub; and a rim formed of a dampening material of a predetermined Shore-hardness arranged between said steel outer ring and said steel hub.

6. The apparatus as defined in claim 5, wherein:

said dampening material of said rolls possesses a Shore-hardness in a range of approximately 40° to 60°.

* * * * *